United States Patent [19]

Calandra, Jr. et al.

[11] Patent Number: 4,969,778

[45] **Date of Patent: * Nov. 13, 1990**

[54] EXPANSION ASSEMBLY FOR MINE ROOF BOLTS UTILIZED IN SMALL DIAMETER BORE HOLES

[75] Inventors: Frank Calandra, Jr.; Mike Cokus, both of Pittsburgh; John C. Stankus, Canonsburg; Paul Yacisin, Patton, all of Pa.

[73] Assignee: Jennmar Corporation, Pittsburgh, Pa.

[ * ] Notice: The portion of the term of this patent subsequent to Feb. 27, 2007 has been disclaimed.

[21] Appl. No.: 429,752

[22] Filed: Oct. 30, 1989

Related U.S. Application Data

[63] Continuation of Ser. No. 367,553, Jun. 19, 1989, Pat. No. 4,904,123.

[51] Int. Cl.[5] ..... E21D 20/02

[52] U.S. Cl. ..... 405/261; 405/259; 411/47

[58] Field of Search ..... 405/259, 261, 260; 411/15, 24, 18, 25, 63, 64, 61, 44, 67, 78

[56] References Cited

U.S. PATENT DOCUMENTS

| | | | |
|---|---|---|---|
| 4,160,615 | 7/1979 | Baldwin | 405/259 |
| 4,162,133 | 7/1979 | Clark et al. | 405/258 |
| 4,419,805 | 12/1983 | Calandra | 405/259 X |
| 4,516,886 | 5/1985 | Wright | 405/261 |
| 4,611,954 | 9/1986 | Cassidy | 405/261 |

*Primary Examiner*—Dennis L. Taylor
*Attorney, Agent, or Firm*—Stanley J. Price, Jr.

[57] ABSTRACT

An improved expansion assembly for a mine roof bolt for use in a nominal one inch diameter bore hole with a nominal ⅝" diameter roof bolt is provided. The expansion assembly has a tapered plug with four tapered surfaces, an expansion shell that has four leaves extending axially upwardly from a support ring and into contact with the four tapered surfaces on the tapered plug, and a threaded support washer to support the expansion shell on the threaded end of a mine roof bolt. The tapered plug has a threaded bore therethrough for threading onto the mine roof bolt. The tapered plug tapered surfaces have an angle of taper of at least 6.5° to the axis of the mine roof bolt. The expansion leaves each have seven serrations formed on the surface such that the serrations are formed by the intersection of a planar surface perpendicular to the axis of the mine roof bolt and a frusto-conical surface. The frusto-conical surface is at an angle of 72.3° to the planar surface. The serrations are equally spaced from each other and have a peak to peak distance of 0.186". The expansion shell has a maximum length of 2.35 inches. The tapered plug has a rounded upper surface and channels running longitudinally between the tapered surfaces on the plug for facilitating use of the expansion assembly with resin. The improved expansion assembly may be utilized with or without resin bonding.

14 Claims, 2 Drawing Sheets

EXPANSION ASSEMBLY FOR MINE ROOF BOLTS UTILIZED IN SMALL DIAMETER BORE HOLES

CROSS REFERENCE TO RELATED APPLICATIONS

This application is a continuation of copending application Ser. No. 367,553, filed on June 19, 1989, entitled "Expansion Assembly for Roof Bolts Utilized In Small Diameter Bore Holes". Now U.S. Pat. No. 4,904,123.

BACKGROUND OF THE INVENTION

1. Field Of The Invention

This invention relates to an improved expansion assembly for mine roof bolts which are utilized in relatively small diameter bore holes. The expansion assembly provides greater gripping forces on the inside of the bore hole in the mine roof than can be obtained by similar prior expansion assemblies. The expansion assembly of the present invention may be utilized with or without resin bonding materials.

2. Description Of The Prior Art

It is well-known in the art of mine roof control to tension bolts anchored in bore holes drilled into the mine roof in order to reinforce the unsupported rock formation above the roof. Conventionally a hole is drilled through the roof into the rock formation. The end of the bolt in the rock formation is anchored either by engagement of an expansion assembly on the end of the bolt with the rock formation, or by bonding the bolt with resin to the rock formation surrounding the bore hole, or by use of both an expansion assembly and resin together to retain the bolt within the hole. Examples of an arrangement utilizing both an expansion assembly and resin to anchor a mine roof bolt are disclosed in U.S. Pat. No. 4,419,805, U.S. Pat. No. 4,413,930, U.S. Pat. No. 4,516,885 and U.S. Pat. No. 4,518,292. Other examples of utilizing both an expansion assembly and resin to anchor a mine roof bolt are shown in U.S. Pat. No. 3,188,815, U.S. Pat. No. 4,162,133, U.S. Pat. No. 4,655,645 and U.S. Pat. No. 4,664,561.

Expansion assemblies for roof bolts have been utilized for many years without resin being utilized in the same installation. There have been countless efforts to improve the configuration of various components of the expansion assemblies to provide better anchoring within the bore hole. When mechanical anchor assemblies are utilized in conjunction with resin bonding material, additional modifications are often made to accommodate the resin bonding material. U.S. Pat. No. 4,764,055 discloses an expansion assembly which has been modified in many respects to accommodate the use of resin bonding material with the mechanical expansion assembly.

The use of a mechanical expansion assembly and resin bonding together in the same bore hole produces a roof bolt whose anchorage depends upon both the characteristics of the expansion assembly and the characteristics of the resin. The use of the resin tends to mask the characteristics of the expansion assembly and many inferior expansion assemblies have been utilized with resin since the resin bonding enhances the mechanical expansion assembly to the extent that inferiorities in the expansion assembly are not readily discernible.

For many applications, it has been found to be desirable to use small diameter bore holes within which to install mine roof bolts. When small diameter bore holes are utilized, the power required to drill the hole is greatly reduced, the size and weight of the drill steel is reduced and the size and weight of the roof bolt utilized in the small diameter hole is also reduced, providing for cost savings and more efficient roof control. Bore holes having a nominal diameter of one inch are considered to be small diameter bore holes and such bore holes are often utilized with resin bonding where no mechanical expansion assembly is provided on the roof bolt.

We have determined that a roof bolt with a mechanical expansion assembly can be very effectively utilized in a one inch bore hole if the mechanical expansion assembly is properly arranged to provide strong gripping action on the inside of the bore hole.

There are, on the market, many types of expansion assemblies that are manufactured with a tapered plug and expansion leaves so that as the tapered plug is threaded into the mine roof bolt, it urges the expansion leaves radially outwardly to grip the interior of the bore hole in which the mine roof bolt is inserted. These earlier expansion assemblies are of two general types. One type has a ring to which are affixed several upwardly extending expansion leaves. The ring surrounds the bolt and the tapered plug moves downwardly toward the ring as the assembly is expanded. Another general type of expansion shell is a bail-type shell in which two expansion leaves are supported by a bail that extends over the end of the mine roof bolt and prevents the expansion leaves from moving axially relative to the bolt. The present invention is directed to an improved expansion assembly that has several upwardly extending expansion leaves affixed to a ring to form an expansion shell. U.S. Pat. No. 4,764,055 discloses this general type of expansion assembly. We have taken a commercially available expansion assembly that has been utilized in bore holes and modified its components so that greatly improved gripping power is generated by the expansion assembly when it is utilized in the bore hole of a mine roof. At the same time, this improved expansion assembly has also been modified so that it may optionally be utilized with resin bonding. It need not, however, be utilized with resin bonding and provides greatly enhanced holding power even if no resin bonding is utilized in conjunction with it.

SUMMARY OF THE INVENTION

We have found that by changing the sizes and angles of various components of an expansion assembly previously utilized in bore holes having a nominal diameter of one inch, that the expansion assembly has greatly enhanced gripping power as is evidenced by pull tests that have been conducted on mine roof bolts utilizing the improved expansion assembly. A series of size and angle changes to the commercially available expansion assembly have been made to provide a surprising improvement in performance of the expansion assembly of the present invention.

In accordance with the present invention there is provided an expansion assembly for a mine roof bolt having a threaded portion with a nominal diameter of ⅝" to be utilized in a bore hole having a 1" diameter. The mine roof bolt itself has a threaded end portion and a bolt head at the other end. The mine roof may be formed as a smooth bolt or it may be formed from rebar that is threaded at one end and headed on the other. Where the ⅝" theaded portion is swaged onto the end of the diameter of a rebar, the dimension can be greater than ⅝". The expansion assembly includes a tapered plug having a body portion with a threaded internal bore adapted to be threaded onto the bolt threaded end portion. The tapered plug has a plurality of tapered surfaces preferably four tapered surfaces on the exterior of the body portion that taper inwardly as the four tapered surfaces extend toward the bolt head when the plug is threaded onto the bolt threaded portion. The four tapered surfaces each form an angle of about 6.5° to the axis of the bolt when the plug is threaded onto the bolt. An expansion shell having a plurality of expansion leaves, preferably four expansion integrally formed with a support ring and positioned on the bolt so that the support ring is closer to the bolt head and the leaves extend in an axial direction toward the bolt threaded portion is provided. Each of the leaves has a serrated outer surface and a smooth inner surface. The expansion leaves surround the bolt at equal circumferentially spaced distances from each other when the expansion shell is positioned on the roof bolt. Each of the leaf smooth inner surfaces is in abutting contact with one of the tapered plug tapered surfaces whereby the leaves are forced radially outwardly when the tapered plug is threaded axially onto the roof bolt and the leaves are restrained from axial movement relative to the roof bolt. Each of the leaf serrated outer surfaces is formed with a plurality of serrations preferably seven serration edges extending from the leaf outer surface preferably in planes parallel to each other and preferably perpendicular to the axis of the bolt. It is preferred that the serrations be and being equally spaced apart a distance of no more than 0.190" and no less than 0.186" apart. The edges of the serrations are formed by intersecting surfaces with the surface closer to the bolt head being substantially planar surface perpendicular to the bolt axis and the surface closer to the bolt threaded portion being a frusto-conical surface whose conical elements are at an angle of about 72.3° to said planar surface. A stop washer is threaded onto the bolt threaded portion closer to the bolt head than the expansion shell whereby the stop washer restricts the expansion shell from axial movement as the plug is threaded onto the bolt threaded portion to force the leaves radially outwardly.

Further another feature of the present invention is the tapered plug body portion has its surface that is positioned closer to the bolt threaded end formed with a rounded edge to facilitate penetration of resin by the expansion assembly. In addition, the tapered plug has longitudinal channels formed between the tapered surfaces to facilitate the flow of resin down, past and around the expansion assembly.

We have found that by increasing the angle of taper on the plug tapered surfaces, by reducing the number of serrations on the outer surface of the expansion leaves, and by reducing the angle between the conical surface and the planar surface forming the serrations, we have been able to greatly enhance the holding power of prior commercially available expansion assemblies that were utilized in nominal 1" diameter bore holes.

In addition, we have been able to adapt the improved expansion assembly to be utilized with resin bonding more efficiently by rounding the edge of the top of the tapered plug, by forming channels in the tapered plug to permit resin to run down alongside the tapered plug within the bore hole, and by providing a stop washer that is smaller than the diameter of the unexpanded tapered plug to permit resin to pass through those channels downwardly from above the expansion assembly to below it. We have also found that when parts of the expansion assembly are pearlitized as by heat treatment, the pearlitization enhances the strength of the iron from which the parts are cast and thereby enhances the gripping ability of the expansion assembly.

Accordingly, the principal object of the present invention is to provide an expansion assembly for use in a nominal 1" diameter bore hole which will produce greatly enhanced gripping power when the expansion assembly is utilized to secure a mine roof bolt in the bore hole.

Another object of the present invention is to provide an improved expansion assembly for a 1" nominal diameter bore hole which may be utilized with or without resin bonding to enhance the capabilities of the expansion assembly.

A further object of the present invention is to provide an improved mine roof bolt expansion assembly which, when utilized with resin bonding, has features that make the resin more effectively flow down, past and around the expansion assembly on the bolt.

These and other objects of the present invention will be more completely disclosed and described in the following specification, the accompanying drawings and the appended claims.

DESCRIPTION OF THE PREFERRED EMBODIMENT

Figure 1:
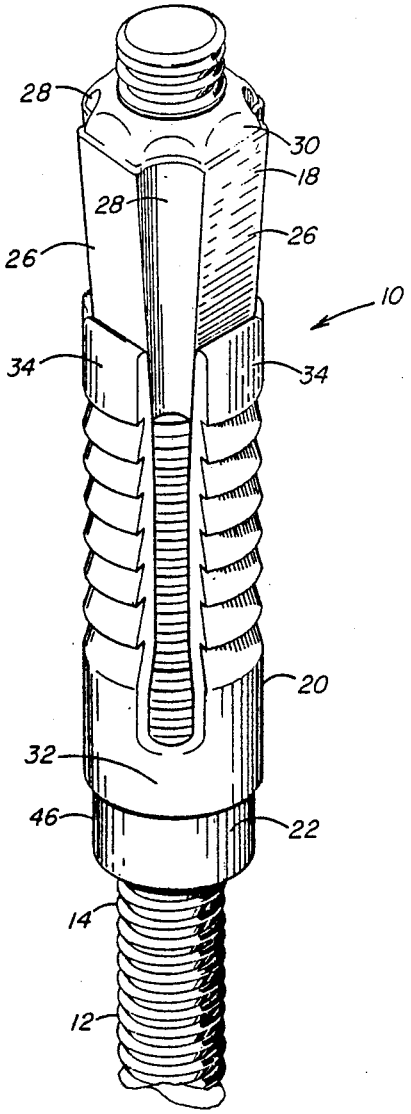
FIG. 1 is a perspective view of the expansion assembly of the present invention.
Figure 2:
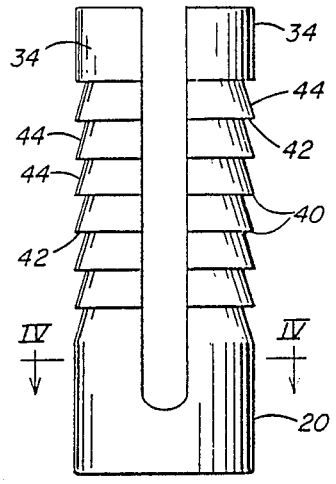
FIG. 2 is an elevational view of the expansion shell of the present invention.
Figure 3:
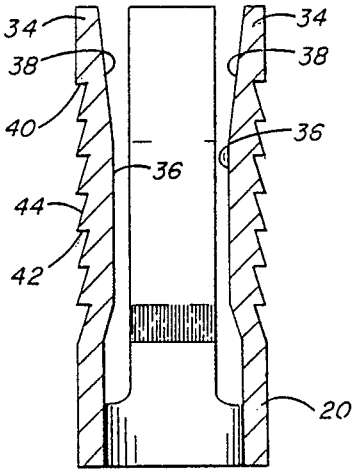
FIG. 3 is an elevational view in section of the expansion shell of the present invention.
Figure 4:
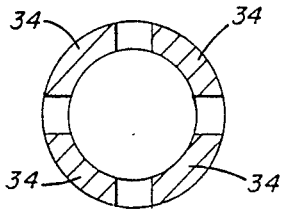
FIG. 4 is a sectional view taken along line IV—IV of FIG. 2.
Figure 7:
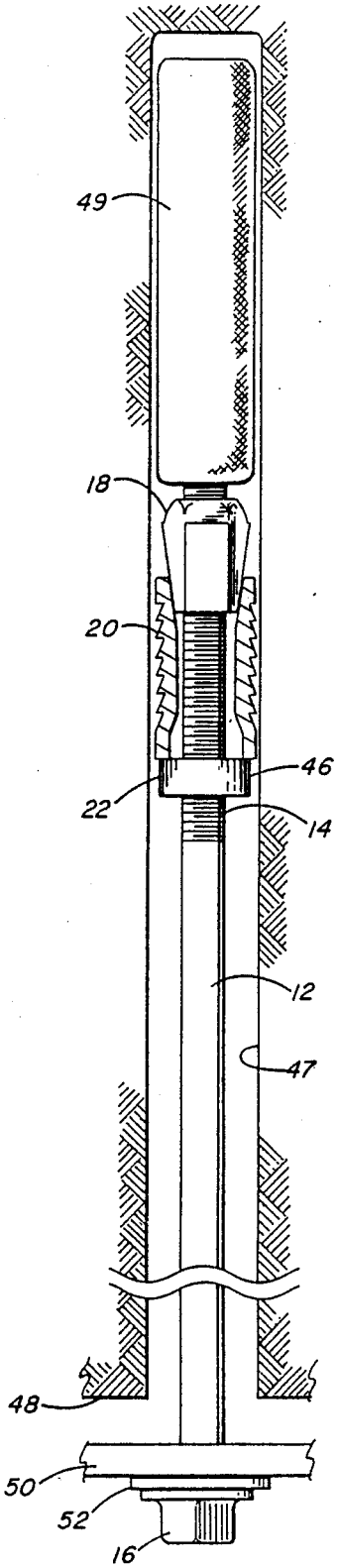
FIG. 7 is a view of the expansion assembly of the present invention on a mine roof bolt positioned within a bore hole in the mine roof.
Figure 8:
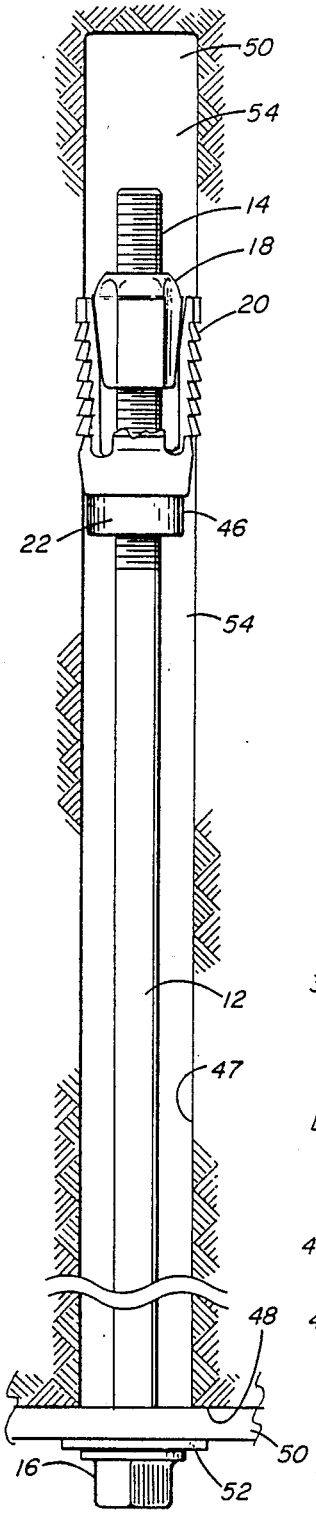
FIG. 8 is the expansion assembly of FIG. 7 expanded within the bore hole in a mine roof.

Referring to the drawings, particularly, to FIG. 1, there is shown an expansion assembly generally designated at 10 which is threaded onto a mine roof bolt 12. As shown in FIGS. 7 and 8, the mine roof bolt 12 has a threaded end 14 and a head 16 formed integrally therewith. The roof bolt 12 may be formed either as a smooth bolt having the threaded end 14 and head 16 or as a rebar that has a threaded end 14 and a head 16.

Figure 5:
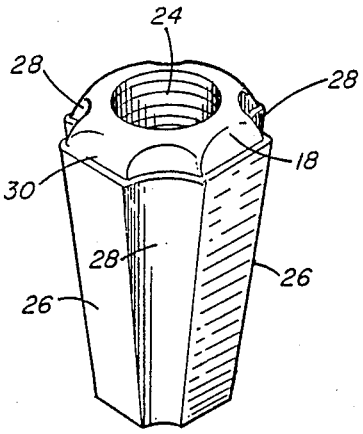
FIG. 5 is a perspective view of the tapered plug of the present invention.

Referring to FIG. 1–5, the expansion assembly 10 has a tapered plug 18, an expansion shell 20 and a stop washer 22. The tapered plug 18 is internally threaded at 24 so that it threadingly receives the threaded end portion 14 of bolt 12. The tapered plug 18 has four tapered surfaces 26 that are longitudinally separated by grooves 28 as best seen in FIGS. 1 and 5. The tapered plug 18 has a rounded end 30 to enable the tapered plug to pass readily through resin in the event that the expansion assembly 10 is used with resin bonding in a bore hole. The grooves 28 permit the resin to pass longitudinally down beyond the plug 18 when resin is utilized.

Figure 6:
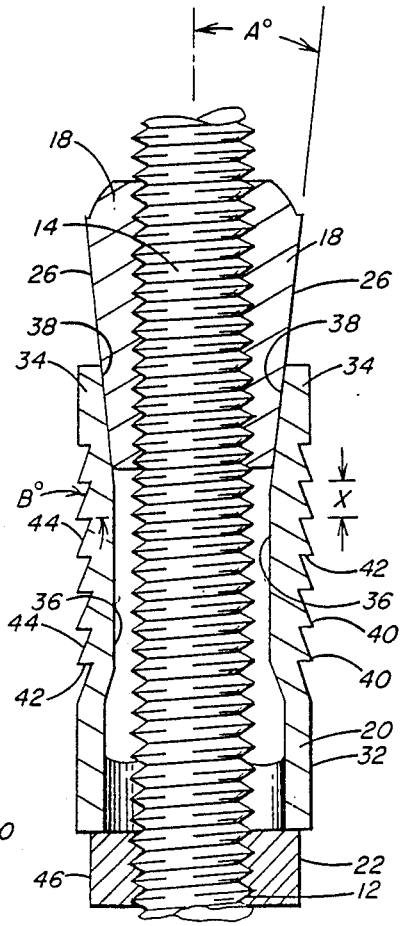
FIG. 6 is a sectional view of the expansion assembly of the present invention in an assembled condition.

As seen in FIG. 6, the four tapered surfaces 26 each form an angle A with the axis of the roof bolt 12 when the tapered plug 18 is threaded onto the threaded end 14 of bolt 12. Angle A is preferably about 6.5°.

The expansion shell 20 has a support ring 32 that encircles the bottom portion of the expansion shell 20. Four leaves 34 extend axially upwardly from the support ring 32 as may be seen in FIG. 1. The leaves 34 have smooth internal surfaces 36 that have tapered portions 38 to register with the tapered surfaces 26 of tapered plug 18.

Each of the leaves 34 on expansion shell 20 has seven serrations 40 formed thereon. The serrations 40 are formed by the intersection of planar surfaces 42 that are perpendicular to the axis of the roof bolt 12 when the expansion shell 20 is in an unexpanded condition and by frusto-conical surfaces 44 whose conical axis coincides with the axis of the roof bolt 12.

As seen in FIG. 6, the frusto-conical surfaces 44 and the planar surfaces 42 come together at an angle B which is about 72.3°. As further seen in FIG. 6, the distance between serrations 40, as indicated at X, is preferably 0.188" but should not be less than 0.186" nor more than 0.188". The entire expansion shell 20 is no more than 2.35" in length.

The expansion assembly of the present invention is designed to be utilized in a bore hole having a nominal diameter of 1". The roof bolt 12 has a nominal diameter of ⅝". The maximum diameter of the tapered plug 18 is 0.960" and the maximum diameter of the unexpanded expansion shell 20 is 0.938".

The expansion shell 20, which fits freely around roof bolt 12 is supported on the roof bolt by stop washer 22. Stop washer 22 is threadingly received on the roof bolt threaded end 14 and has a cylindrical external surface 46. The diameter of cylindrical external surface 46 is less than the unexpanded diameter of expansion shell 20 so as not to inhibit the flow of resin down and around the expansion assembly 10 when the expansion assembly is utilized with resin.

As seen in FIGS. 7 and 8, the expansion assembly 10 and roof bolt 12 are utilized in a bore hole 47 formed within a mine roof 48. In this instance, the expansion assembly 10 and roof bolt 12 are utilized with resin bonding. It will be appreciated that the expansion assembly 10 of the present invention need not be utilized with resin bonding.

As shown in FIG. 7, a resin capsule 49 is positioned within bore hole 47 above the expansion assembly 10. Expansion assembly 10 and roof bolt 12 rupture the resin capsule 49 and cause the resin to flow downwardly over the expansion assembly 10. As the roof bolt is rotated, the contents of the resin capsule 49 are mixed together to form free resin 54 as shown in FIG. 8. In conventional fashion, the roof plate 50 and washer 52 that surround roof bolt 12 at its head 16 are drawn upwardly against the mine roof 48 as the roof bolt 12 continues to be rotated and threaded through the tapered plug 18.

Because of the construction of tapered plug 18 with grooves 28 and rounded end 30, the expansion assembly 10 passes easily up into the free resin 54 and the resin flows downwardly around and past the expansion assembly 10 and stop washer 22. The expansion assembly 10 of the present invention may readily be utilized with resin bonding to provide a secure anchor within the bore hole 47.

We have found that the configuration of the expansion assembly 10 of the present invention provides a very efficient mechanical expansion arrangement for a mine roof bolt even when utilized without resin bonding. In three tests of a roof bolt constructed in accordance with that described herein, the following results were obtained.

Test No. 1. An expansion assembly on a nominal ⅝" bolt that was 34" long was expanded in a test bore with an installed torque of 200 foot pounds. No resin was utilized. Under a load of 18,000 pounds there was a total deflection of the bolt of only 0.220".

Test No. 2. An expansion assembly on a nominal ⅝" bolt that was 34" long was expanded in a test bore with an installed torque of 200 foot pounds. No resin was utilized. Under a load of 18,000 pounds there was a total deflection of the bolt of only 0.198".

Test No. 3. An expansion assembly on a nominal ⅝" bolt that was 34" long was expanded in a test bore with an installed torque of 200 foot pounds. No resin was utilized. Under a load of 18,000 pounds there was a total deflection of the bolt of only 0.153".

According to the provisions of the Patent Statutes, we have explained the principle, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. An expansion assembly for a mine roof bolt having a threaded portion with a nominal diameter of five-eighths of an inch to be utilized in a bore hole having a nominal one inch diameter, said mine roof bolt having said threaded portion at one end and a bolt head at the other end, said expansion assembly comprising:

a tapered plug having a body portion with a threaded internal bore adapted to be threaded onto said bolt threaded end portion, said tapered plug having a plurality of tapered surfaces on the exterior of said body portion that taper inwardly as said tapered surfaces extend toward said bolt head when said plug is threaded onto said bolt threaded portion, said plurality of tapered surfaces each forming an angle of about 6.5° to the axis of said bolt when said plug is threaded onto said bolt;

an expansion shell having a plurality of expansion leaves integrally formed with a support ring and positioned on said bolt so that said support ring is closer to said bolt head and said leaves extend in an axial direction toward said bolt threaded portion, said leaves each having a serrated outer surface and a smooth inner surface, said expansion leaves surrounding said bolt at equal circumferentially spaced distances from each other when said expansion shell is positioned on said roof bolt, each of said leaf smooth inner surfaces being in abutting contact with one of said tapered plug tapered surfaces whereby said leaves are forced radially outwardly when said tapered plug is threaded axially onto said roof bolt and said leaves are restrained from axial movement relative to said roof bolt, each of said leaf serrated outer surfaces being formed with a plurality of serration edges extending around said leaf outer surface and being equally spaced a distance apart of between about 0.190" and 0.186", said edges of said serrations being formed by intersecting surfaces with the surface closer to said bolt head being a planar surface perpendicular to said bolt axis and the surface closer to said bolt threaded portion being a frusto-conical surface whose conical elements are at an angle of about 72.3° to said planar surface; and a stop washer threaded onto said bolt threaded portion closer to said bolt head than said expansion shell whereby said stop washer restricts said expansion shell from axial movement as said plug is threaded onto said bolt threaded portion to force said leaves radially outwardly.

2. The expansion assembly of claim 1 wherein said tapered plug body portion has the surface positioned closer to said bolt threaded end formed with a rounded edge to facilitate penetration of resin by said expansion assembly.

3. The expansion assembly of claim 1 wherein said tapered plug body portion has longitudinal channels formed therein between said plug tapered surfaces to facilitate the flow of resin down, past and around said expansion assembly.

4. The expansion assembly of claim 1 wherein said tapered plug has a maximum diametrical dimension of 0.960" and said expansion shell has a maximum diametrical dimension of 0.938" in the unexpanded state.

5. The expansion assembly of claim 1 wherein said tapered plug body portion has the surface positioned closer to said bolt threaded end formed with a rounded edge, said tapered plug body portion has longitudinal channels formed therein between said plug tapered surfaces and said stop washer has a maximum diameter less than the maximum diameter of said expansion shell in the unexpanded condition so that penetration of resin by said expansion assembly is facilitated and the flow of resin down, past and around said expansion assembly is facilitated.

6. The expansion assembly of claim 1 wherein said expansion leaf smooth inner surfaces each have a portion adjacent the end closer to said bolt threaded portion that is tapered to receive said plug tapered surfaces.

7. The expansion assembly of claim 1 wherein said stop washer has a cylindrical outer surface.

8. An expansion shell of a mine roof bolt expansion shell assembly for a mine roof bolt having a threaded portion with a nominal diameter of $\frac{5}{8}$ of an inch to be utilized in a bore hole having a nominal 1" diameter comprising four expansion leaves integrally formed with a support ring and extending axially from said support ring, each of said expansion leaves having a serrated outer surface and a smooth inner surface, said serrated outer surface having seven separate serrations formed thereon, each of said serrations being formed by the intersection of a planar surface and a conical surface whereby each planar surface is perpendicular to the axis of said mine roof bolt in the position assumed by said expansion leaf relative to said bolt in the unexpanded condition of said expansion assembly and each conical surface has its conical elements at an angle of about 72.3° to said planar surfaces, said serrations being equally spaced from each other a distance of about 0.118".

9. The expansion shell of claim 8 wherein the total length of said shell does not exceed 2.35".

10. An expansion assembly for a mine roof bolt having threaded portion with a nominal diameter of five-eighths of an inch to be utilized in a bore hole having a nominal one inch diameter, said mine roof bolt having an threaded portion at one end and a bolt head at the other end, said expansion assembly comprising:

a tapered plug having a body portion with a threaded internal bore adapted to be threaded onto said bolt threaded end portion, said tapered plug having four tapered surfaces on the exterior of said body portion that taper inwardly as said four tapered surfaces extend toward said bolt head when said plug is threaded onto said bolt threaded portion, said four tapered surfaces each forming an angle to the axis of said bolt when said plug is threaded onto said bolt, said tapered plug body portion having the surface positioned closer to said bolt threaded end formed with a rounded edge to facilitate penetration of resin by said expansion assembly, said tapered plug having longitudinal channels formed therein between said plug tapered surfaces to facilitate the flow of resin down, past and around said expansion assembly;

an expansion shell having four expansion leaves integrally formed with a support ring and positioned on said bolt so that said support ring is closer to said bolt head and said leaves extend in an axial direction toward said bolt threaded portion, said leaves each having a serrated outer surface and a smooth inner surface, said expansion leaves surrounding said bolt at equal spaced distances from each other when said expansion shell is positioned on said roof bolt, each of said leaf smooth inner surfaces being in abutting contact with one of said tapered plug tapered surfaces whereby said leaves are forced radially outwardly when said tapered plug is threaded axially onto said roof bolt and said leaves are restrained from axial movement relative to said roof bolt, each of said leaf serrated outer surfaces having a plurality of separate serrations formed thereon, each of said serrations being formed by the intersection of a planar surface and a conical surface whereby each planar surface is perpendicular to the axis of said mine roof bolt in the position assumed by said expansion leaf relative to said bolt in the unexpanded condition of said expansion assembly and each said conical surface has its conical elements at an angle to said planar surfaces, said serrations being equally spaced from a distance of about 0.108 and a stop washer threaded onto said bolt threaded portion closer to said bolt head than said expansion shell whereby said stop washer restricts said expansion shell from axial movement as said plug is threaded onto said bolt threaded portion to force said leaves radially outwardly.

11. The expansion assembly of claim 10 wherein said tapered plug has a maximum diametrical dimension of 0.960" and said expansion shell has a maximum diametrical dimension of 0.938" in the unexpanded state.

12. The expansion assembly of claim 10 wherein said expansion leaf smooth inner surfaces each have a portion adjacent the end closer to said bolt threaded portion that is tapered to receive said plug tapered surfaces.

13. The expansion assembly of claim 10 wherein said stop washer has a cylindrical outer surface.

14. The expansion shell of claim 10 wherein the total length of said shell does not exceed 2.35".

* * * * *